US009808837B2

(12) United States Patent
Curien

(10) Patent No.: US 9,808,837 B2
(45) Date of Patent: Nov. 7, 2017

(54) WIRELESS CLEANING APPARATUS USING ELECTRICAL ENERGY TO PRODUCE CALORIES

(71) Applicant: ECODROP, Chaumousey (FR)

(72) Inventor: Gerard Curien, Housseras (FR)

(73) Assignee: ECODROP, Chamousey (FR)

( * ) Notice: Subject to any disclaimer, the term of this patent is extended or adjusted under 35 U.S.C. 154(b) by 359 days.

(21) Appl. No.: 14/413,643

(22) PCT Filed: Jul. 11, 2013

(86) PCT No.: PCT/FR2013/051662

§ 371 (c)(1),
(2) Date: Jan. 8, 2015

(87) PCT Pub. No.: WO2014/009666

PCT Pub. Date: Jan. 16, 2014

(65) Prior Publication Data

US 2015/0202659 A1 Jul. 23, 2015

(30) Foreign Application Priority Data

Jul. 12, 2012 (FR) ..... 12 56740

(51) Int. Cl.
*B08B 3/02* (2006.01)
*F22B 1/28* (2006.01)

(52) U.S. Cl.
CPC ..... *B08B 3/02* (2013.01); *F22B 1/282* (2013.01); *F22B 1/284* (2013.01); *B08B 2203/007* (2013.01); *B08B 2230/01* (2013.01)

(58) Field of Classification Search
CPC .... A47L 11/34; A47L 11/4088; A47L 13/225; A47L 11/4083; A47L 11/4016;
(Continued)

(56) References Cited

U.S. PATENT DOCUMENTS 8,549,697 B1 * 10/2013 Moyher, Jr. ..... A47L 11/34 15/319
8,554,063 B2 10/2013 Hsu
(Continued)

FOREIGN PATENT DOCUMENTS

DE 29814690 U1 12/1998
DE 10209465 A1 10/2003
(Continued)

*Primary Examiner* — Robert Scruggs
(74) *Attorney, Agent, or Firm* — Andrew W. Chu; Craft Chu PLLC

(57) ABSTRACT

A wireless cleaning apparatus uses electrical energy to produce calories. Steam is generated with a view to carrying out a cleaning operation by spraying steam. The steam generator includes a water tank, a heater of the water in order to produce steam, and an extractor for the steam produced heater of the steam includes storage for calories generated, prior to the cleaning operation, by electrical connections for producing heat that can be reversibly connected to an electric power supply includes a solid body, which is traversed by at least one channel or similar, which links the water tank to the means for extracting steam, and through which the water travels.

11 Claims, 3 Drawing Sheets

(58) Field of Classification Search
CPC ..... B08B 2203/0229; B08B 3/024; B08B 2230/01; B08B 3/02; F22B 1/282; F22B 1/284
See application file for complete search history.

(56) References Cited

U.S. PATENT DOCUMENTS

| | | | | |
|---|---|---|---|---|
| 2007/0130718 | A1* | 6/2007 | Chung | A47L 11/34 15/320 |
| 2011/0280553 | A1* | 11/2011 | Hsu | F22B 1/28 392/394 |

FOREIGN PATENT DOCUMENTS

| | | | |
|---|---|---|---|
| FR | 2721539 | A1 | 12/1995 |
| WO | 0011412 | A1 | 3/2000 |

* cited by examiner

WIRELESS CLEANING APPARATUS USING ELECTRICAL ENERGY TO PRODUCE CALORIES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a wireless cleaning apparatus using electrical energy for producing calories, and in particular to a steam-projection cleaning apparatus.

The use of steam for cleaning has many advantages over conventional methods. Thus, steam permits to eliminate the use of detergents, to destroy germs and bacteria, to use very little water, and to act quickly.

2. Description of Related Art Including Information Disclosed Under 37 CFR 1.97 and 37 CFR 1.98

Already known are cleaning apparatus using steam projection, which have the drawback of an uneasy implementation and a lack of mobility, namely in case of a punctual and unpredictable intervention, for example.

Indeed, these apparatus need to be connected, through a power cable, to the power network at an electrical outlet near the place of intervention, or to a remote socket but using an electrical extension cord.

This is for example the case of the apparatus described in FR 2 721 539 and DE 2 98 14 690 U, which allow to project steam, but which, to this end, need to be connected to the power network.

There exist no electrically operated wireless cleaning apparatus capable of projecting steam.

It should be noted that already known are wireless irons capable of producing steam during the ironing operation. However, these irons are associated with a base electrically connected to the network, to which the iron must permanently be connected for its recharging, which is not a handicap in the practice of ironing, since the latter requires the iron to be regularly and frequently placed on its support, while the user does not have to move. This is not the case with a cleaning apparatus, which may require a continuous use, as well as movements of the user.

SUMMARY OF THE INVENTION

The aim of the present invention is to cope with this drawback by providing a wireless cleaning apparatus using electrical energy for the production of calories, and in particular to a steam-projection cleaning apparatus.

The wireless cleaner using electrical energy for the production of calories according to the invention is characterized in that it includes steam-generating means with a view to carrying out a cleaning operation by projection of steam, said steam-generating means comprising:

a water tank, a means for heating this water in order to produce steam, means for extracting the steam produced, and wherein said means for heating and producing steam comprises:

a means for storing the calories generated, prior to said cleaning operation, by electrical means for producing heat that can be reversibly connected to an electric power supply, said storage means comprising a solid body, and wherein said solid body is also traversed by at least one channel or the like, which connects said water tank to said steam-extracting means, and through which passes the water.

According to an additional feature of the cleaning apparatus according to the invention, the solid body consists of a metal block.

According to another additional feature of the cleaning apparatus according to the invention, the solid body consists of an aluminum block.

According to another additional feature of the cleaning apparatus according to the invention, the channel or channels or the like the solid body comprises has a non-rectilinear path.

According to another additional feature of the cleaning apparatus according to the invention, the tank is associated with means for preheating water contained in said tank.

According to another additional feature of the cleaning apparatus according to the invention, it comprises in addition heating means powered by batteries, designed capable of maintaining the temperature of the solid body.

According to another additional feature of the cleaning apparatus according to the invention, at least part of its peripheral jacket is hollow, such as to constitute the water tank.

According to another additional feature of the cleaning apparatus according to the invention, the tank and/or the means for heating and producing steam and its electrical means for producing heat are in the form of a removable module with a view to its recharging.

According to another additional feature of the cleaning apparatus according to the invention, the solid body is in the form of at least two concentric tubular portions delimiting between them a concentric tubular space in which is closely arranged a spiral structure creating a spiral passage for the passing through of the water proceeding from the tank.

According to another additional feature of the cleaning apparatus according to the invention, the at least two concentric tubular portions are traversed by a resistor divided into several segments, one for each of said portions, configured in a spiral shape.

According to another additional feature of the cleaning apparatus according to the invention, the tank is arranged concentrically to the concentric tubular portions, internally or externally thereto.

The advantages and features of the cleaning apparatus according to the invention will become clear from the following description, which refers to the attached drawing, which shows a non-restrictive embodiment.

DETAILED DESCRIPTION OF THE DRAWINGS

Figure 1:
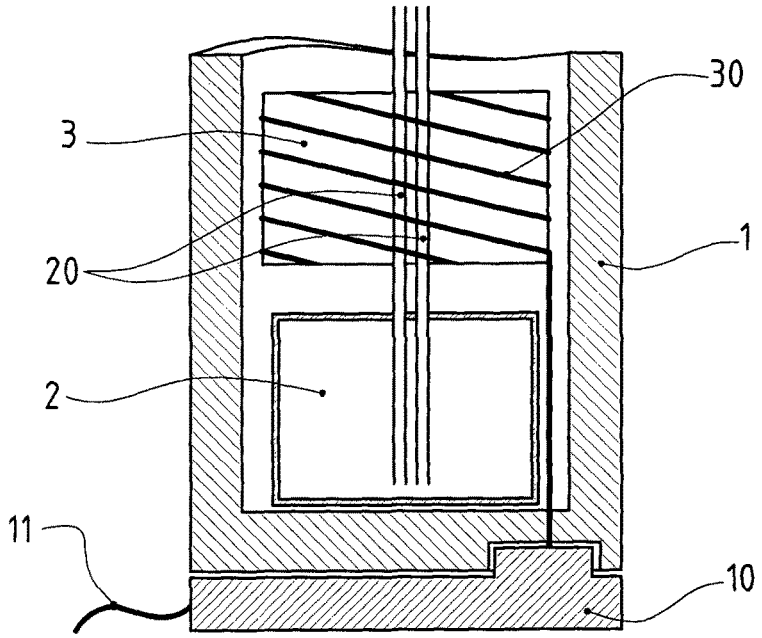
FIG. 1 shows a schematic cross-sectional view of a cleaning apparatus according to the invention.

When referring to FIG. 1, we can see a cleaning apparatus according to the invention. It includes:

- an outer jacket 1, preferably made of a heat-insulating material, or provided to be associated with a layer of such heat-insulating material,
- a water tank 2,
- a metal block 3, arranged above the tank 2, capable of being heated by an electrical means for producing heat, in this case a resistor 30,
- one or several tubes 20, in this case two, which plunge into the tank 2, which pass through the metal block 3, in order to emerge at one end of the apparatus, not shown, in order to diffuse there the steam being produced,
- a base 10 to which the jacket 1 can be adapted in order to permit to reversibly connect the resistor 30 to an electric power supply 11.

In practice, the resistor 30 brings the metal block 3 to temperature, then, when the required temperature is reached, for example 160°, which is controlled by suitable means, the apparatus can be separated from the base 10, in order to be capable to be brought to the place of use where a means, not shown, for pumping water is pushed into the tubes 20, until the portion thereof that passes through the metal block 3, where it is converted into steam, which is expelled under pressure out of the pipes 20 by a diffuser, not shown. This water can be pushed simply under the action of the pressure contained in its tank due to its preheating and through an opening valve placed between the tank and the heating body the metal block constitutes, which will finish the transformation of the water into steam. It should be noted that the pressure obtained in the water tank will be limited to the resistance to the pressure of the tank, but can easily be of about 1 bar, which will provide a greater autonomy. This valve device operating under pressure will permit the apparatus not to include any electrically operating element, a pump for example, and thus permits to omit the presence of a battery.

The supply of the metal block with water from the tank can also occur by gravity and a valve for opening the tank in the case the tank would be placed above the metal block.

The cleaning apparatus according to the invention thus permits to use the cleaning properties of steam, without the drawbacks of the wired apparatus currently used.

Of course, the duration of steam generation is limited to the capability of the metal block to retain a sufficiently high temperature.

Figure 2:
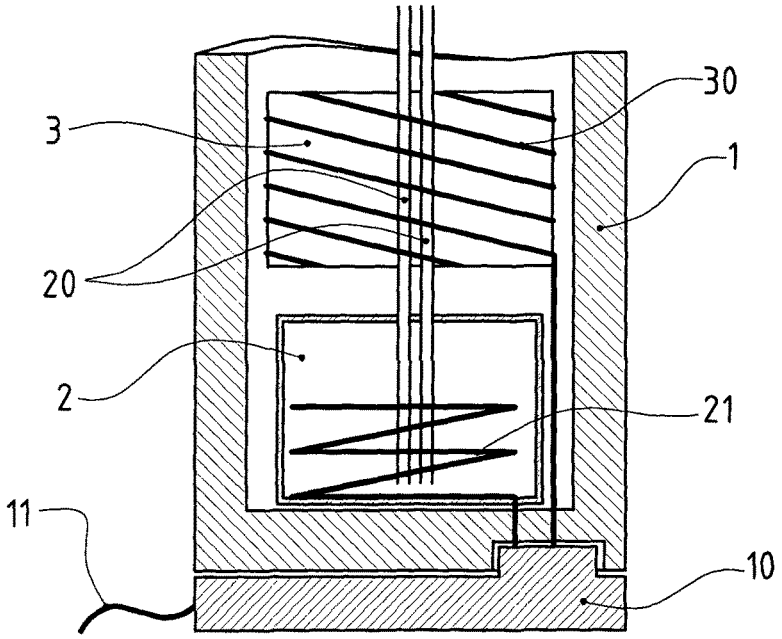
FIG. 2 shows a schematic cross-sectional view of a variant of the same cleaning apparatus.

When referring to FIG. 2, it can be seen, in a variant of the cleaning apparatus according to the invention, that the tank 2 includes a resistor 21 also likely to be connected to the base 10 in order to be electrically powered, and which permits to preheat the water contained in the tank 2, about 70° C. for example, or even more depending on the resistance provided to the construction of this tank 2 so as to increase the duration of use.

Indeed, due to the storage of an already hot water, the calories stored in the block 3 are used only to raise the temperature of this water up to its vaporization.

Figure 3:
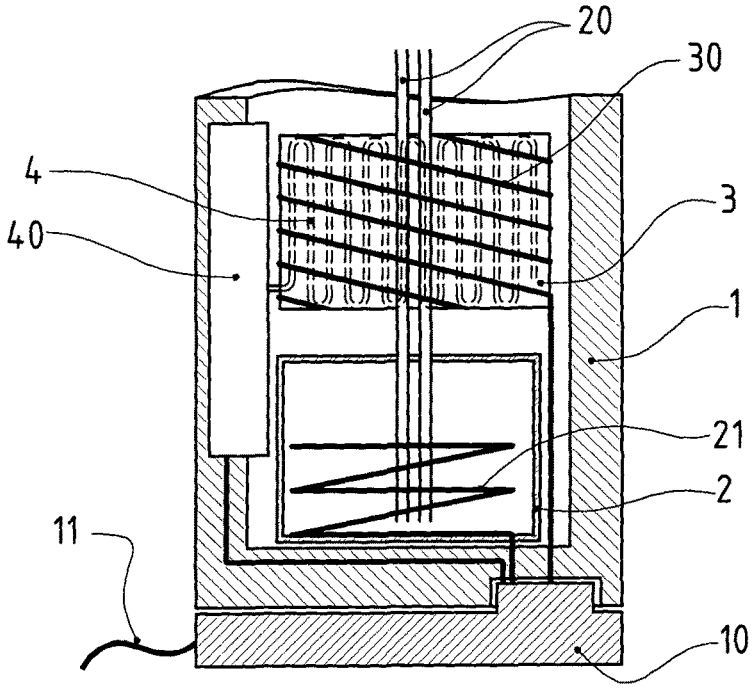
FIG. 3 shows a schematic cross-sectional view of another variant of the same cleaning apparatus.

Referring now to FIG. 3, we can see another variant of the cleaning apparatus according to the invention, shown in a non-restrictive way with the previous variant, where the metal block 3 is provided with a resistor 4, powered by a battery 40 likely to be connected to the base 10 in order to be electrically recharged. This resistor 4 is aimed at being implemented after separation from the base 10, in order to maintain the heat of the block 3, such as to increase the duration of use. This battery 40 can also be associated with a remote power transmission apparatus, since this technique is applicable today.

Figure 4:
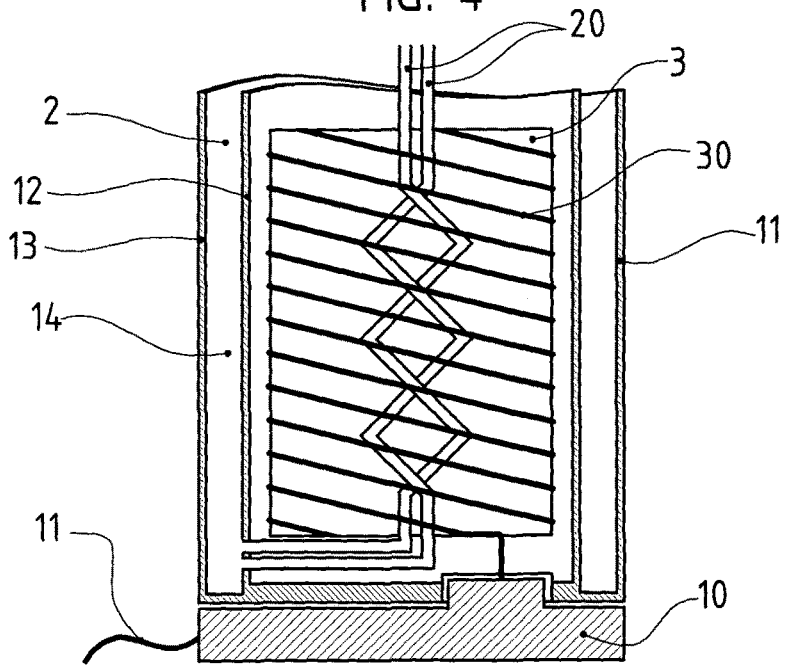
FIG. 4 shows a schematic cross-sectional view of another variant of the same cleaning apparatus.

Referring now to FIG. 4, we can see another variant of the cleaning apparatus according to the invention, wherein the peripheral jacket 1 is comprised of two skins 12 and 13, which delimit a space 14 aimed at constituting the water tank.

This configuration permits to preserve an inner space in which are placed the metal block 3 and the electric means for producing heat 30, which has several advantages, namely that the electrical means for producing heat 30 can be used to preheat the water contained between the two skins 12 and 13, and that this water and the two skins 12 and 13 created by an insulating wall permit to omit the use of a layer of insulating material.

Furthermore, we can see that tubes 20 that traverse the metal block 3 do not follow a rectilinear path, but spiral through them. It should be noted that the tubes 20 can adopt many shapes, such as to increase the surface of exchange.

It should also be noted that it is possible to integrate one or more resistors into the space 14, such as to carry out the preheating of the water.

Figure 5:
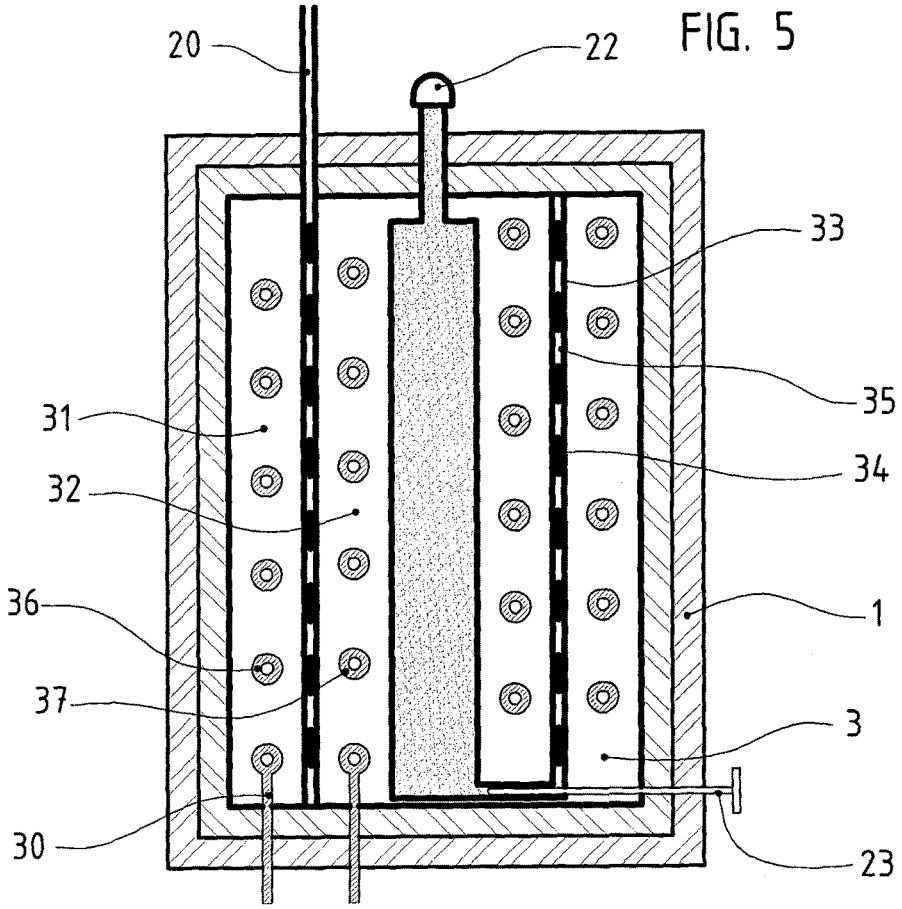
FIG. 5 shows a schematic cross-sectional view of another variant of the same cleaning apparatus.
Figure 6:
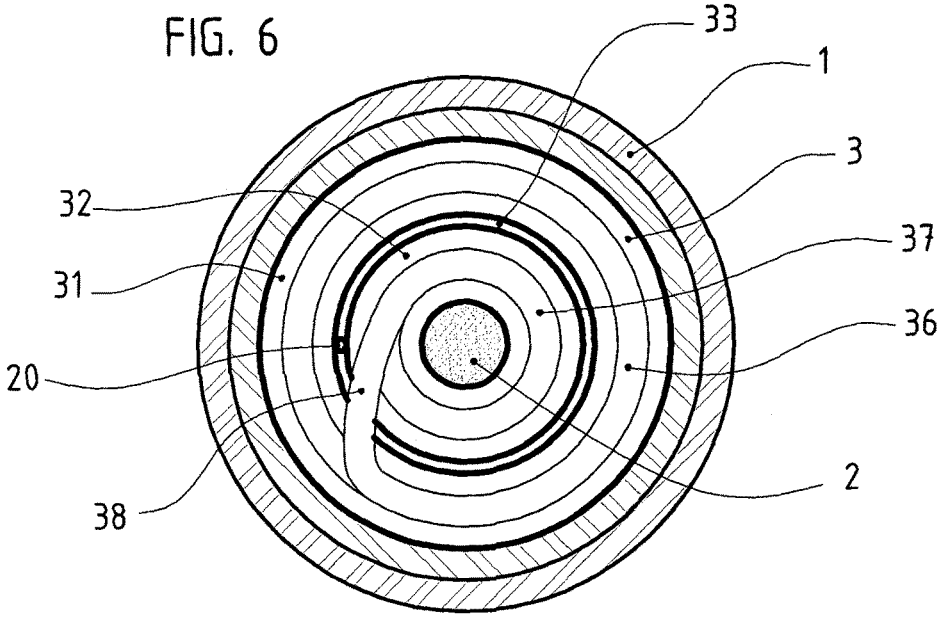
FIG. 6 shows a schematic cross-sectional view of the variant of FIG. 5.

When referring now to FIGS. 5 and 6, we can see another variant of the cleaning apparatus according to the invention.

In these figures, we see the outer jacket 1 made of a heat-insulating material, a water tank 2 arranged centrally and provided with a safety valve 22, a solid body 3 capable of storing calories and preferably consisting of a metal block, preferably aluminum, a resistor 30 that traverses the solid body 3, a tube 20 that passes through the solid body 3 and through which passes the water proceeding from the tank 2 in order to be transformed into steam.

In this embodiment, the outer jacket 1 is, non-restrictively but preferably, of a general cylindrical shape, as well as the body 3 and the tank 2, which are concentric.

The body 3 is arranged in two concentric tubular portions 31 and 32 delimiting a tubular space 33, in which is closely arranged a spiral structure 34, which can consist of a spiral spring, which creates, between the windings, a spiral passage 35 for the passing through of the water proceeding from the tank 2 through a valve 23, and which ends into the tube 20.

On the other hand, the block 3 is traversed by an electric resistor 30 comprising two spiral segments 36 and 37, each associated with one of the concentric tubular portions 31 and 32, respectively, and united through a bridge 38, visible in 6, which passes through the tubular space 33.

It should be noted that according to a variant not shown, the tank 2 can be arranged externally to the block 3.

Generally speaking, the cleaning apparatus according to the invention can consist of a combination of several of the variants described above.

Finally, for an easy use, the cleaning apparatus according to the invention can include a removable modular portion, which can comprise at least the tank and the metal block 3 its resistor 30.

It is thus possible to be able to have several modules, permitting one of them to be prepared while another one is used.

What is claimed:

1. A wireless cleaning apparatus using electrical energy for production of calories, said wireless cleaning apparatus comprising:

a steam generator being comprised of:

a water tank;

a means for heating water into steam; and a means for extracting steam;

a solid body, wherein calories generated by electricity are stored in said solid body, said calories being from said means for heating when said means for heating is connected to an electric power supply, and wherein said calories heat water within said solid body when said means for heating is not connected to said electric power supply; and at least one channel traversing within said solid body and having a connection to said water tank at one end of said solid body and another connection to said means for extracting steam at an opposite end of said solid body.

2. The cleaning apparatus, according to claim 1, wherein the solid body comprises a metal block.

3. The cleaning apparatus, according to claim 2, wherein said solid body comprises an aluminum block.

4. The cleaning apparatus, according to claim 1, wherein the channel traversed on the solid body has a non-rectilinear path.

5. The cleaning apparatus, according to claim 1, further comprising: means for preheating water contained in said water tank.

6. The cleaning apparatus, according to claim 1, further comprising: an additional heating means powered by batteries so as to maintain temperature of the solid body.

7. The cleaning apparatus, according to claim 1, wherein said water tank is comprised of a hollow peripheral jacket.

8. The cleaning apparatus, according to claim 1, wherein said water tank and said means for heating are in removable engagement with said electric power supply.

9. The cleaning apparatus, according to claim 1, wherein the solid body comprised of at least two concentric tubular portions, defining a concentric tubular space, and a spiral structure within said concentric tubular space creating a spiral passage, said at least one channel being comprised of said spiral passage.

10. The cleaning apparatus, according to claim 9, wherein the at least two concentric tubular portions are traversed by a resistor divided into several segments, each segment corresponding to both tubular portions and being configured in a spiral shape.

11. The cleaning apparatus, according to claim 9, wherein said water tank is arranged concentrically to the concentric tubular portions.

* * * * *